US007549305B2

(12) United States Patent
Yun et al.

(10) Patent No.: US 7,549,305 B2
(45) Date of Patent: Jun. 23, 2009

(54) DOOR ON DRUM TYPE WASHING MACHINE OR LAUNDRY DRYER

(75) Inventors: Ju Hwan Yun, Bucheon-si (KR); Seong Hai Jeong, Changwon-si (KR); Soon Jo Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 657 days.

(21) Appl. No.: 10/629,774

(22) Filed: Jul. 30, 2003

(65) Prior Publication Data

US 2004/0020246 A1 Feb. 5, 2004

(30) Foreign Application Priority Data

Jul. 31, 2002 (KR) ..... 10-2002-0045342

(51) Int. Cl.
*B08B 3/12* (2006.01)
*B08B 33/00* (2006.01)
*B08B 39/00* (2006.01)

(52) U.S. Cl. ..... 68/3 R; 68/3; 68/12.01; 68/12.26

(58) Field of Classification Search ..... 68/3, 68/12.26, 3 R, 12.01
See application file for complete search history.

(56) References Cited

U.S. PATENT DOCUMENTS 3,223,276 A * 12/1965 Heinrich et al. ..... 220/232
5,195,647 A * 3/1993 Studt ..... 220/810
5,548,978 A 8/1996 Bongini et al.
5,799,647 A * 9/1998 Mills ..... 126/200
6,109,277 A * 8/2000 Linton et al. ..... 134/56 R
2003/0110813 A1 6/2003 Nitschmann et al.
2004/0020246 A1 2/2004 Yun et al.
2004/0050117 A1 * 3/2004 Geyer et al. ..... 68/139

FOREIGN PATENT DOCUMENTS

DE 19515040 A1 10/1996
DE 19515040 A1 10/1996
DE 10053413 A1 5/2002
EP 851177 A1 * 7/1998
EP 0953807 A2 11/1999
JP 03191998 8/1991
JP 04114695 4/1992
JP 8-117484 A1 5/1996
JP 2001269498 10/2001
WO WO 02/34994 A1 5/2002

* cited by examiner

*Primary Examiner*—Michael Barr
*Assistant Examiner*—Rita R Patel
(74) *Attorney, Agent, or Firm*—McKenna Long & Aldridge LLP

(57) ABSTRACT

Door on a laundry dryer/drum type washing machine including a door frame having a central opening, for opening/closing an opening in a front part of a cabinet for introduction/taking out of laundry, an outer window fixed to a front surface of the door frame, and an inner window fixed to a rear surface of the door frame, wherein the door frame has a front surface curved in left/right directions, and the outer window is curved the same with the door frame, thereby providing a good design of a door and improving washing and drying performance.

23 Claims, 6 Drawing Sheets

DOOR ON DRUM TYPE WASHING MACHINE OR LAUNDRY DRYER

This application claims the benefit of the Korean Patent Application No. P2002-0045342 filed on Jul. 31, 2002, which is hereby incorporated by reference for all purposes as it fully set forth herein.

BACKGROUND OF THE INVENTION

1. Field of the Invention

The present invention relates to drum type washing machines and laundry dryers, and more particularly, to a door on a drum type washing machine or a laundry dryer.

2. Discussion of the Related Art

In general, the drum type washing machine washes laundry by introducing detergent and the laundry into an inside of a drum of a washing machine, and rotating the drum, for washing the laundry using impact and friction as the laundry is lifted and dropped by projected parts.

Drum type washing machines have become more widely used overtime because they do almost no damage to the laundry, do not tangle the laundry, and consume less water. The laundry dryer automatically dries laundry that is wet from washing. The drum type washing machine and the dryer have a door for prevention of escaping of the laundry.

A related art door on the laundry dryer will be described with reference to the attached drawing.

Referring to FIG. 1, the related art laundry dryer is provided with a cabinet 100, a drum 30, a warm air supplying passage 10, and a warm air discharge passage 90. There is an opening 40*a* in a front surface of the cabinet 100 for introduction of/removing the laundry into/out of the drum type washing machine. The drum 30, having a plurality of lifts 30*a* provided on an inside surface is rotatably mounted in the cabinet 100.

There is a driving part in a lower part of the cabinet 100 for providing a rotating power to the drum 30. The driving part is provided with a motor 80, a driving pulley 81 connected to a driving shaft of the motor 80, and a belt 85 connected between the driving pulley 81 and the drum 30.

The warm air supplying passage 10 and the warm air discharge passage 90 are in the rear of the cabinet 100, for introduction/discharge of external air into/from the drum 30.

There is a heater 20 inside of the warm air supplying passage for heating the air. There is a discharge fan 70 connected to a motor 80 in a front part of the warm air discharge passage 90 for discharging the heated air.

In The meantime, there is a door 60 on a side of the cabinet 100 for open/close of opening 40*a*. The door 60, in general formed of thick steel plate, is flat and opaque.

Though the discussion up to now is on the laundry dryer, in general, the drum type washing machines used currently also serve as the dryers. Therefore, the door 60 is applicable to the drum type washing machine, too.

First, currently, it is known that a design of a product is one of very important parameters in marketing goods. However, the related art door 60 of a flat design has a limitation in enhancing a sense of beauty.

Second, the related art door 60 on the laundry dryer or the drum type washing machine, without a window for looking an interior, can not check a state of the laundry inside of the drum.

Third, the related art door 60 on the laundry dryer or the drum type washing machine can not make the laundry to move toward the inside of the drum, to cause entangle of the laundry, that deteriorates drying or washing performance.

SUMMARY OF THE INVENTION

Accordingly, the present invention is directed to a door on a drum type washing machine or a laundry dryer that substantially obviates one or more of the problems due to limitations and disadvantages of the related art.

An advantage of the present invention is to provide a door on a drum type washing machine or a laundry dryer, a design of which is good, and which improves a washing or drying performance.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, the door on a laundry dryer/drum type washing machine includes a door frame having a central opening, for opening/closing an opening in a front part of a cabinet for introduction/taking out of laundry, an outer window fixed to a front surface of the door frame, and an inner window fixed to a rear surface of the door frame.

The door frame has a front surface curved in left/right directions, and the outer window is curved the same with the door frame.

The door frame has a rim projected forward from a front periphery thereof for enclosing an outer periphery of the outer window to protect an edge part of the outer window.

The outer window is attached to the front surface of the door frame with a fixing agent, and the inner window is attached to the rear surface of the door frame with the fixing agent. The fixing agent for attaching the outer window has a color the same with a paint coated on the door frame.

Preferably, the outer door and the inner door are formed of glass.

The door further includes a gasket on the rear surface of the door frame for prevention of leakage of heat air from an inside to an outside through a gap between the opening in the cabinet and the door frame.

The gasket has hook parts for joining with the door frame, and the door frame has gasket holes in the rear surface for inserting the hook parts to fix the gasket.

The door frame further includes a width of seating groove in conformity with the gasket in the rear surface, and the gasket holes are formed within the seating groove.

The door frame further includes a width of seating surface around the opening in the rear surface thereof for placing an edge surface of the inner window.

The door frame further includes a bent part projected backward from an outer periphery of the seating surface for increasing a rigidity of an inner window attaching region.

The outer window may have a coat of ceramic paint applied to an inside surface of an entire part thereof excluding a part facing the opening of the door frame.

The door frame further includes an outer door frame having a central first opening, and an inner door frame having a second opening in communication with the first opening, and joined to a rear side of the outer door frame.

The outer door frame further includes a first flange projected backward from a peripheral surface of the first opening. The inner door frame further includes a second flange projected forward from a peripheral surface of the second opening.

The first flange has a projection height which increases as it approaches a lower side of the outer door frame, to form a slope angle when seen from a side. The slope angle is in a range of about 1°~20, and, preferably, in a range of about 8°~10°.

The second flange has a projection height which becomes the higher as it goes toward the farther from an upper side to a lower side of the inner door frame, to form a slope angle when seen from a side. The slope angle is in a range of about 1°~20°, and, preferably, in a range of about 8°~10°.

The first flange has a plurality of hooks on an outer peripheral surface, and the second flange has hook fastening holes fastened to the hooks respectively, and the outer door frame has a front surface curved in left/right directions, and the outer window is curved corresponding with the outer door frame.

The outer door frame has a rim projected forward from a front periphery thereof for enclosing an outer periphery of the outer window to protect an edge part of the outer window, and the outer window is attached to the front surface of the outer door frame with a fixing agent, and the inner window is attached to the rear surface of the inner door frame with the fixing agent.

The fixing agent for attaching the outer window has a color the same as or similar to a paint coated on the outer door frame.

The door further includes a gasket on the rear surface of the inner door frame for prevention of leakage of heat air from an inside to an outside through a gap between the opening in the cabinet and the inner door frame, and the gasket has hook parts for joining with the inner door frame, and the inner door frame has gasket holes in the rear surface for inserting the hook parts to fix the gasket.

The inner door frame further includes a width of seating groove in conformity with the gasket in the rear surface, and the gasket holes are formed within the seating groove, a width of seating surface around the second opening in the rear surface thereof for placing an edge surface of the inner window, and a bent part projected backward from an outer periphery of the seating surface for increasing a rigidity of an inner window attaching region.

The outer window has a coat of ceramic paint applied to an inside surface of an entire part thereof excluding a part facing the first opening of the door frame.

The door frame further includes an outer door frame having a plurality of hooks on an inside of an outer rim surface, and an inner door frame having hook holes in an outer rim thereof for joining with the hooks.

In another aspect of the present invention, there is provided a laundry dryer/drum type washing machine including a cabinet having an opening for introduction/taking out of laundry therethrough, a drum rotatably mounted in the cabinet, having a plurality of lifts on an inside peripheral surface, a motor for providing a driving power to the drum, a door frame for opening/closing an opening in the cabinet, the door frame having a central opening for see through the inside of the drum, an outer window mounted on a front surface of the door frame, and an inner window mounted on a rear surface of the door frame.

The door frame includes an outer door frame having a central first opening, and an inner door frame joined to rear of the outer door frame, the inner door frame having a second opening in communication with the first opening.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
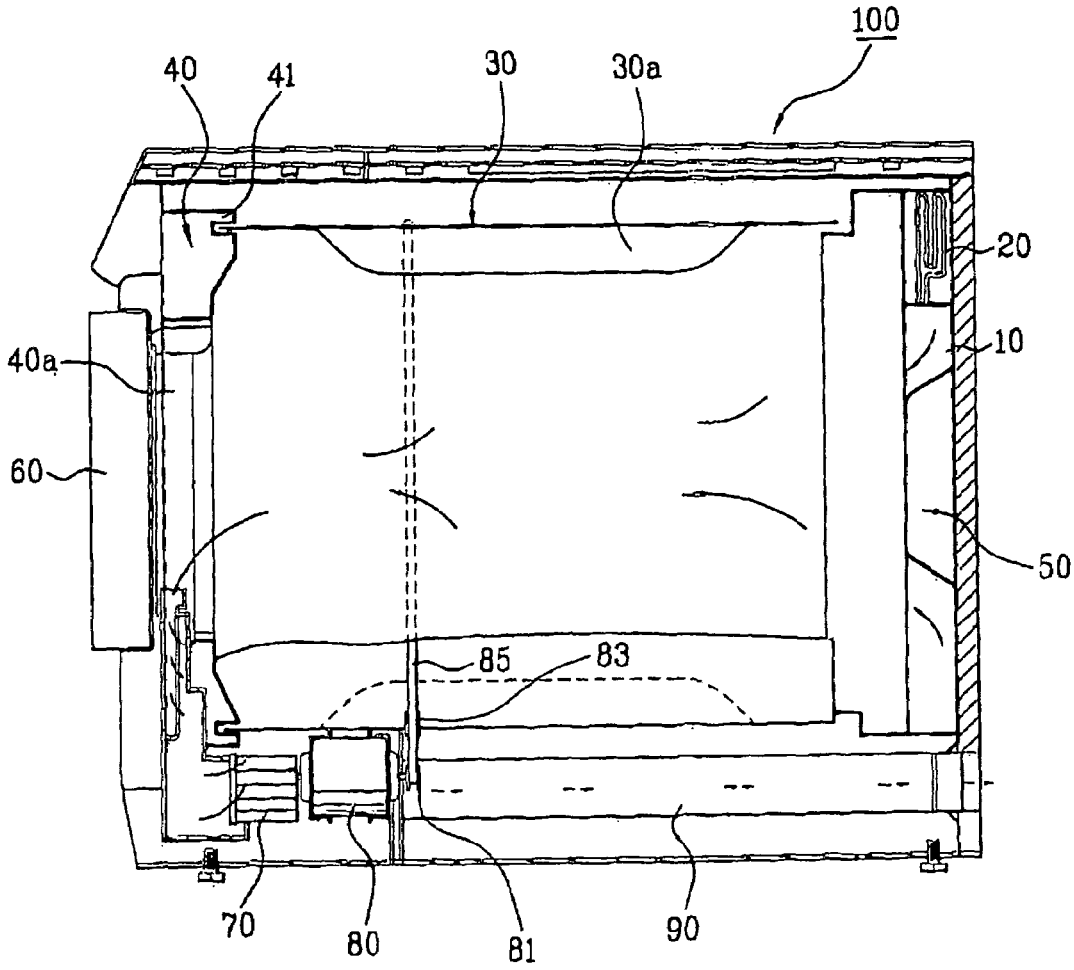
FIG.1 Related Art
FIG. 1 illustrates a section showing a related art laundry dryer, schematically.
Figure 2:
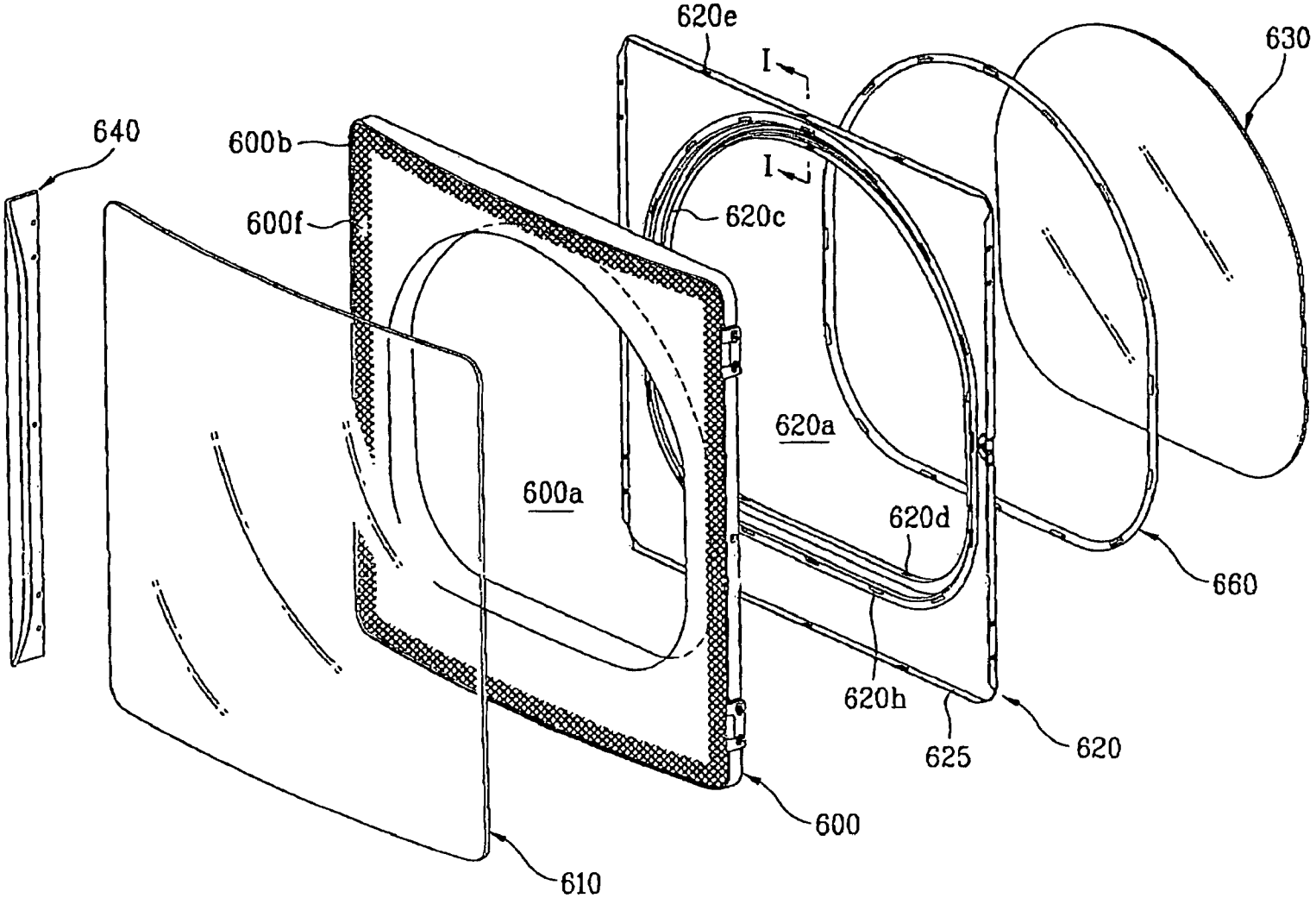
FIG. 2 illustrates a disassembled perspective view of a door in accordance with a embodiment of the present invention.

Referring to FIG. 2, the door includes an outer door frame 600, an inner door frame 620, an outer window 610, an inner window 630, and a door handle 640.

The outer door frame 600 has a front surface curved in left/right directions, and a first opening 600*a* in a central part for looking inside. The inner door frame 620 is positioned to the rear of the outer door frame 600 and has a second opening 620*a* in a central part in communication with the first opening 600*a*.

The outer window 610, which has a curve corresponding with the curve of the front surface of the outer door frame 600, is mounted on the front surface of the outer door frame 600, and the inner window 630 is mounted on a rear surface of the inner door frame 620. The door handle 640 is mounted to one side of the outer door frame 600.

Elements of the door on a laundry dryer/drum type washing machine will be described in more detail.

The outer door frame 600 has a rim 600*b* projected forward from a front periphery thereof. The rim 600*b* encloses an outer periphery of the outer window 610 mounted to a front surface of the outer door frame 600, for protecting the outer periphery and preventing infiltration of foreign matters.

Figure 3:
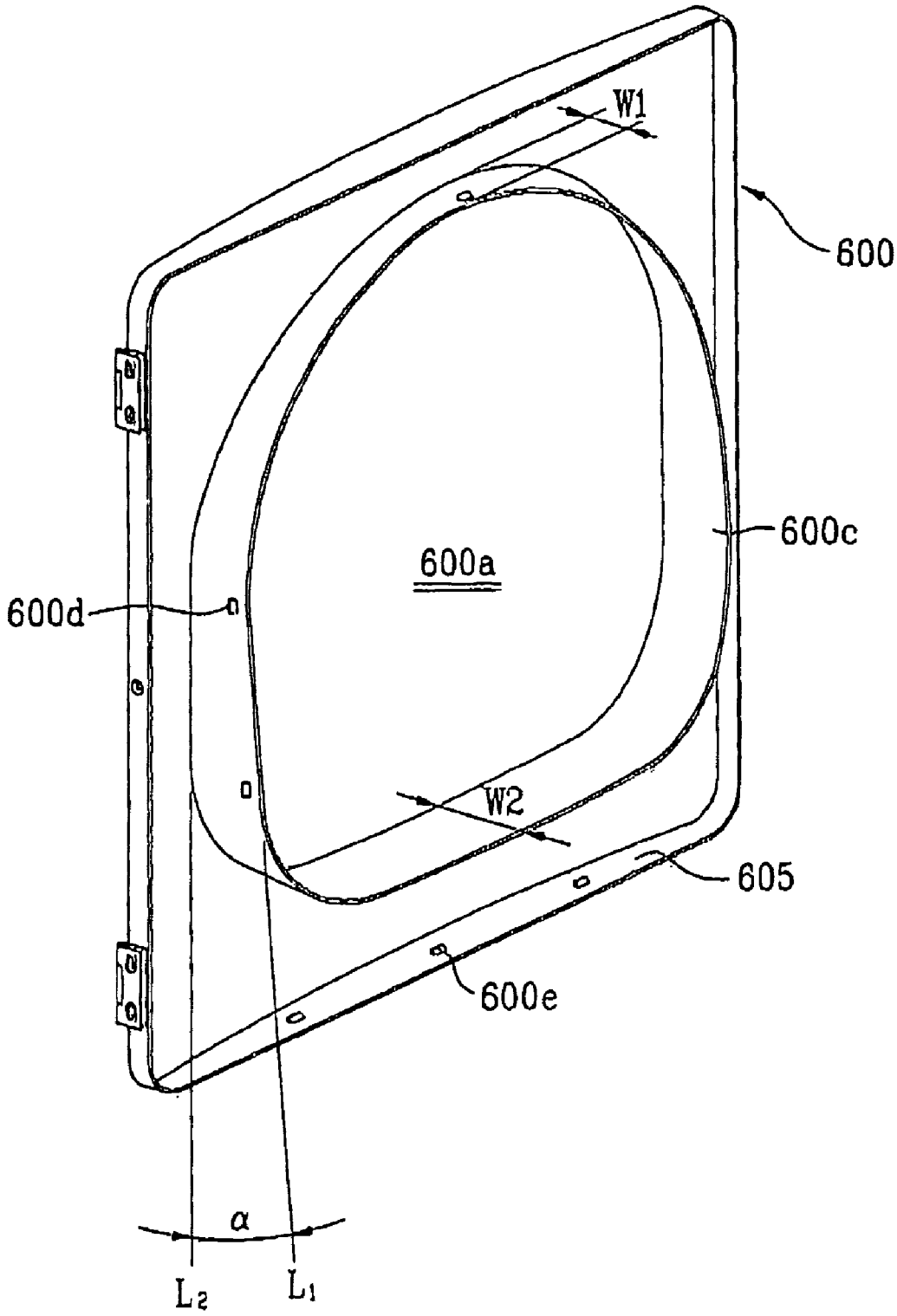
FIG. 3 illustrates a back side perspective view of an outer door frame in FIG. 2.

Referring to FIG. 3, the outer door frame 600 has a first flange 600*c*. The first flange 600*c* is projected backward from a periphery of the first opening 600*a*, to form an inside surface of the first opening 600*a*.

The first flange 600*c* has a lower side projection height W2 greater than an upper side projection height W1. That is, the first flange 600*c* has a projection height which increases approaching the lower side, such that the first flange 600 forms a slope angle 'α' when viewed from a side.

In more detail, the slope angle 'α' is an angle between a line L1 connecting a distal end of an upper part and a distal end of the lower part of the first flange 600*c* and a vertical line L2. The slope angle 'α' may be set to be in a range of about 1°~20°, and in particular, about 8°~10°.

The first flange 600*c* reinforces strength of the outer door frame 600, and covers such that an inside of the outer door frame 600 cannot be seen.

Figure 4:
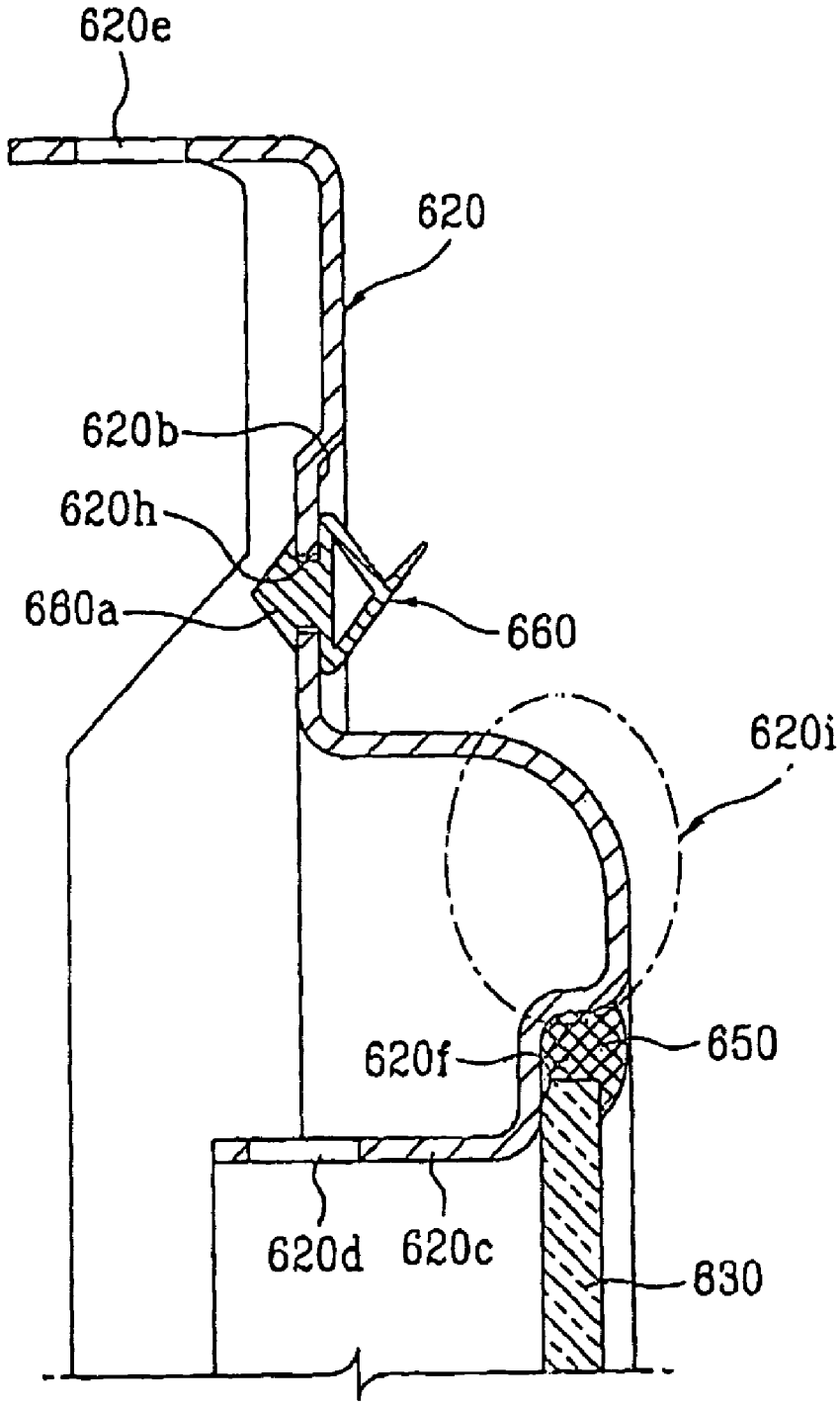
FIG. 4 illustrates a section across a line I-I in FIG. 2.

Referring to FIGS. 2 and 4, the inner frame 620 has a second flange 620*c* projected forward from a periphery of the second opening 620*a* and joined with the first flange 600*c*. Like the first flange 600*c*, the second flange 620*c* also has an upper part projection height lower than a lower part projection height. That is, the second flange 620*c* has a height which increases as it approaches the lower side of the inner door frame 620, such that the second flange 620*c* also has a slope angle (not shown) when viewed from a side.

The slope angle of the second flange 620*c* may also be set to be in a range of about 1°~20°, and more preferably, about 8°~10°.

In the meantime, for joining the flanges 600*c* and 620*c*, the first flange 600*c* has a plurality of hooks 600*d* at regular intervals along a periphery of an outside surface thereof, and the second flange has hook fastening holes 620*d* for fastening the hooks 600*d* thereto.

Figure 5A:
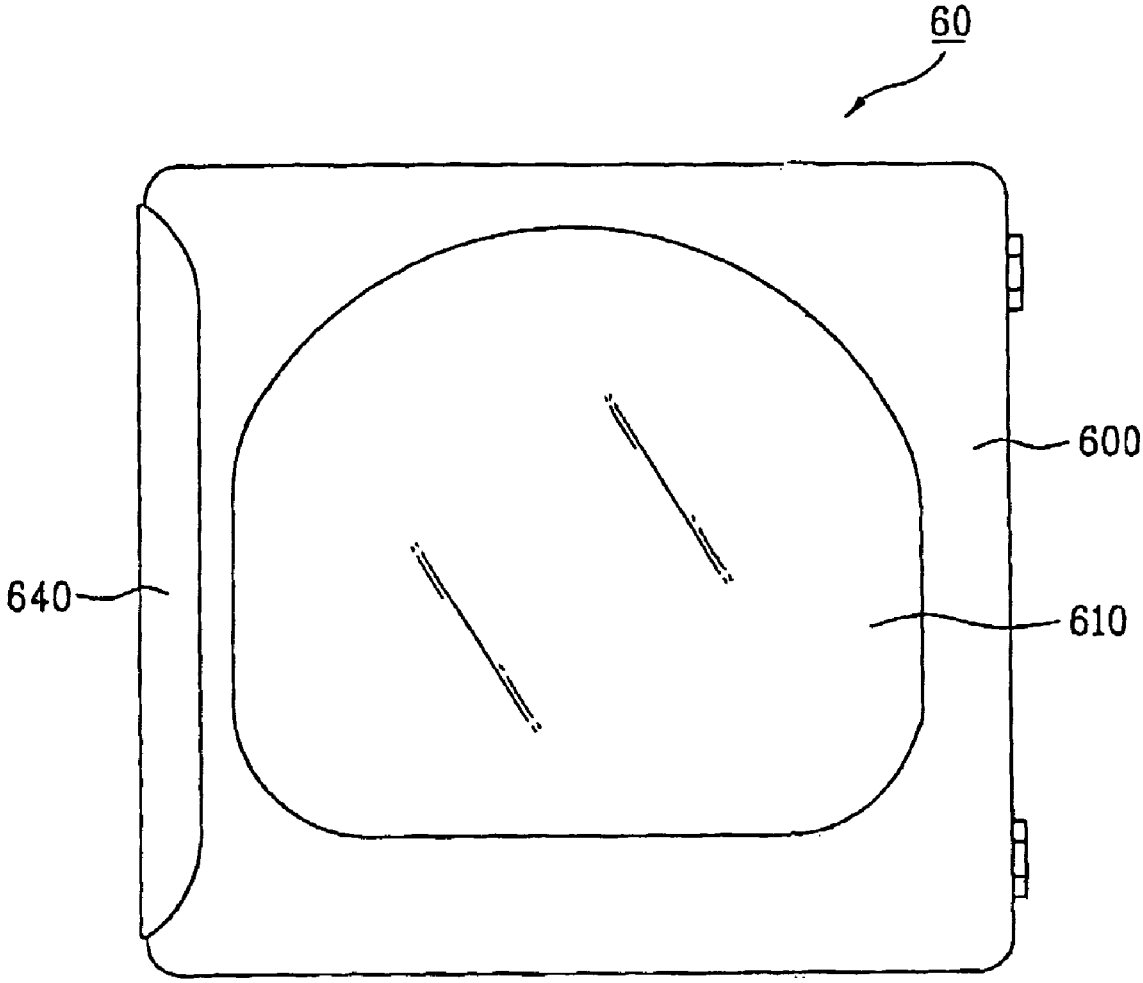
FIG. 5A illustrates a front view showing an assembled state of FIG. 2.
Figure 5B:
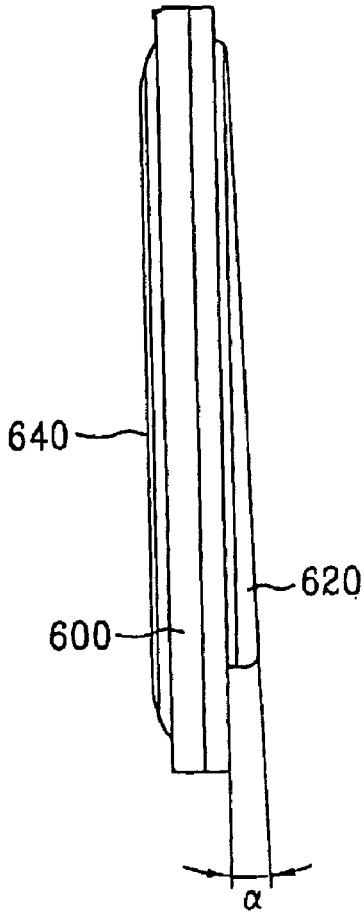
FIG. 5B illustrates a right side view showing an assembled state of FIG. 2.

Referring to FIG. 5B, when the first and second flanges 600*c* and 620*c* are assembled by means of the hooks 600*d* and the hook fastening holes 620*d*, a rear surface of the inner door frame 620 has a slope angle the substantially the same as the flanges 600*c* and 620*c*.

Moreover, for assembly of the outer door frame 600 and the inner door frame 620, a plurality of hooks 600*e* are formed on an inside of a outer rim 605 of the outer door frame 600, the outer rim 605 projecting from the outer door frame 600 in a direction toward the inner door frame 620. A plurality of hook holes 620*e* are formed in an outer rim of the inner door frame 620, the outer rim 625 of the inner door frame 620 projection from the inner door 620 in a direction toward the outer door frame 600 for fastening the hooks 600*e* thereto.

In the meantime, referring to FIG. 4, the inner window 630 is attached to a rear surface of the inner door frame 620 with a liquid sealant 650, a fixing agent, which will be described in more detail.

The inner door frame has a width of recessed seating surface 620*f* on the rear surface thereof around the second opening 620*a*. An edge of the inner window 630 is placed on the seating surface 620*f* and the sealant 650 is coated on the seating surface 620*f*, to attach the inner window 630 to the inner door frame 620.

There may be a bent part 620*i* on an outer periphery of the seating surface 620 for increasing a rigidity of an inner window attaching region. The bent part 620*i* is projected backward beyond the inner window 630 for protection of the inner window 630.

The outer window 610 is also attached to a sealant coating region 600*f* of the outer door frame 600 with the sealant 650, a fixing agent. The sealant 650 fixes the outer window 610 to the outer door frame 600, and prevents infiltration of moisture and foreign matter between the outer window 610 and the outer door frame 600.

The sealant, being a liquid, preferably has a color the same as or similar to a paint coated on the door 600. For example, as home appliances are mostly white, if the door 600 is white, white sealant 650 is used.

In the meantime, the outer window 610 and the inner window 630 may be formed of glass for prevention of scratches. In this instance, ceramic paint is coated on an inside surface of the outer window 610. The ceramic paint is coated only on part excluding the first opening 600*a* for improving an outer appearance.

In the meantime, as illustrated in FIG. 4, the door of the present invention may be provided with a gasket 660 to a rear surface of the inner door frame 620, for prevention of leakage of the heated air from inside of the drum. As shown in FIG. 4, the gasket 660 has a plurality of hook parts 660*a* for joining with the inner door frame 620. The inner door frame 620 has a plurality of gasket holes 620*h* for joining with the hook parts 660*a*.

The inner door frame 620 may have a width of recessed gasket seating groove 620*b* in the rear surface in conformity with a form of the gasket. In this instance, the plurality of gasket holes 620*h* are formed within the gasket seating groove 620*b*.

Accordingly, when the hook parts 660*a* are joined with the gasket holes 620*h* in the inner door frame 620, the gasket 660 is seated in the gasket groove 620 of the inner door frame 620.

The door of the present invention described up to now has a structure of the door frame including the outer door frame 600 and the inner door frame 620.

However, the outer door frame 600 and the inner door frame 620 may be unified into one, when the first and second flanges 600*c* and 620*c* are unified into one, and the rear surface slope angle α of the inner door frame 620 is formed by sloping the rear surface of the door frame directly.

When the door frames are unified, the openings 600*a* and the 620*a* are also unified, and the hooks 600*d* and 600*e*, the hook fastening holes 620*d*, and the hook holes 620*e* are not required.

An assembly process and operation of the foregoing door on a laundry dryer/drum type washing machine in accordance with an embodiment of the present invention will be described.

The sealant 650 is coated on an inside of the rim 600*b* on a periphery of the outer door frame 600. The sealant 650 may be a color the same as or similar to a paint coated on the outer door frame 600. Then, the outer window 610 is attached to a front surface of the inside of the rim 600*b* of the outer door frame 600.

In more detail, a width of the liquid sealant 650 is coated to the front surface of the outer door frame 600 of the inside region of the rim 600*b*, and the outer window 610 is attached to the front surface of the outer door frame 600 of the inside region of the rim 600*b*. Then, as the sealant 650 sets, the outer window 610 is attached to the outer door frame 600, firmly.

Figure 5C:
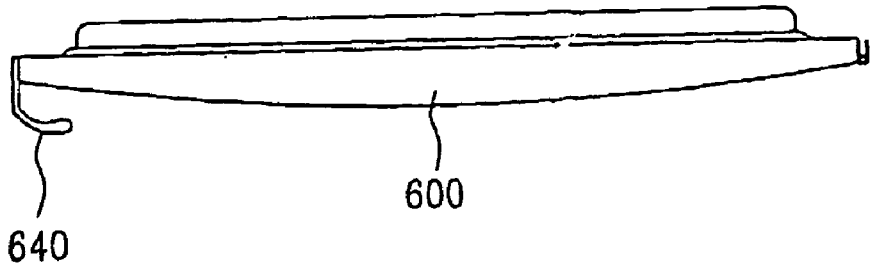
FIG. 5C illustrates a plan view showing an assembled state of FIG. 2.

The rim 600*b* encloses, and protects the edge of the outer window 610. The sealant 650 fixes the outer window 610 to the outer door frame 600. The sealant 650 also seals and prevents infiltration of moisture and foreign matter between the outer window 610 and the front surface of the outer door frame 600. Then, as illustrated in FIGS. 5A and 5C, the door handle 640 is joined to the one side of the outer door frame 600.

Next, a process for attaching the inner window 630 and a process for fastening the gasket 660 will be described.

The edge of the inner window 630 is placed on the inner window seating surface 620*f*. Then, the sealant 650 is coated on a peripheral surface of the inner window 630 (see FIG. 4). As the sealant 650 sets, the inner window 630 is attached to the inner door frame 620, firmly.

Next, the gasket 660 is fastened to the rear surface of the inner door frame 620 as the hook parts 660*a* join with the gasket holes 620*h*, respectively. The gasket 660 fastened thus prevents leakage of the heated air in the drum 30 through the door to an outside of the drum in a state the door 60 is closed.

When individual assembly processes are finished, the outer door frame 600 and the inner door frame 620 are assembled, which will be described in more detail.

The plurality of hooks 600*d* on the outside surface of the first flange 600*c* and the hook fastening holes 620*d* in the second flange 620*c* are respectively aligned. Along with this, the plurality of hooks 600*e* on an inside of an outer rim surface 605 of the outer door frame and hook holes 620*e* in the outer rim surface 615 of the inner door frame 620 are aligned.

Then, when the outer door frame 600 is pressed toward the inner door frame 620, the hooks 600*d* on the first flange 600*c* are respectively inserted in the hook fastening holes 620*d*. Thus, the outer door frame 600 and the inner door frame 620 are assembled into a door.

The assembled door of the present invention is illustrated in FIGS. 5A-5C. Referring to FIG. 5B, it can be noted that the rear surface of the inner door frame 620 the inner window is attached thereto has the slope angle '$\alpha$' formed by the flanges 600*c* and 620*c*. Accordingly, the inner window 620 attached to the rear surface of the inner door frame 620 has the slope angle '$\alpha$', too.

Moreover, as the front surface of the outer door frame 600 is curved in left/right directions, the door has a convex front surface.

The door on a laundry dryer/drum type washing machine of the present invention assembled thus has the following advantages.

First, the backward projection of the first flange 600*c* to form an inside surface of the first opening 600*a* reinforces a strength of the outer door frame 600. Since the first flange 600*c* covers the inner door frame 620 to be invisible from an outside, an outer appearance of the door is improved.

Second, the inner window 630 attached to the rear surface of the inner door frame 620 with the slope angle '$\alpha$' always causes the laundry falling in a forward direction of the drum 30 (after having been lifted by the lift 30*a* on an inside of the drum 30) to slide on the sloped surface of the inner window 630, and fall toward a center part of the drum 30. The slope angle of the inner window 630 prevents entangling of the laundry and exposes the laundry to the warm air, thereby improving drying performance and efficiency.

Third, the assembly of the outer door frame 600 and the inner door frame 620 by means of the hook fastening improves workability of the assembly.

Fourth, the curved outer window 610 of glass and the curved outer door frame 600 provides a better aesthetic appearance in view of design.

Fifth, the see-through window in the door of the present invention permits checking of a state of the laundry in the drum.

It will be apparent to those skilled in the art that various modifications and variations can be made in the present invention without departing from the spirit or scope of the invention.

Along with this, the door 60 of the present invention is applicable not only to the laundry dryer/drum type washing machine, but also to other home appliances that would benefit from the ability to see an inside thereof.

Thus, it is intended that the present invention cover the modifications and variations of this invention provided they come within the scope of the appended claims and their equivalents.

What is claimed is:

1. A door on a laundry dryer/drum type washing machine for opening/closing an opening in a front part of a cabinet for introduction/taking out of laundry, comprising:

an outer door frame having a first central opening and a first flange projected backward from a periphery of the first central opening, wherein a top of the first flange projects into the cabinet less than a bottom of the first flange such that a rear surface of the first flange forms a slope angle $\alpha$ when viewed from a side;

an inner door frame having a second central opening and a second flange projected from a periphery of the second central opening, wherein a rear surface of the second flange forms the slope angle $\alpha$ when viewed from a side;

an outer window fixed to a front surface of the outer door frame;

an inner window fixed to the rear surface of the inner door frame, wherein the inner window is inclined at the slope angle $\alpha$ when viewed from a side; and a gasket fixed to the rear surface of the inner door frame, wherein the gasket is adapted to prevent leakage of air from an inside to an outside of the cabinet and wherein the second frame and the gasket are hidden from view from an outside of the cabinet by the first flange, wherein the outer door frame has a front surface curved in left/right directions, and the outer window is curved the same way as the front surface of the outer door frame.

2. The door as claimed in claim 1, wherein the door frame has a rim projected forward from a front circumference thereof for enclosing an outer circumference of the outer window to protect an edge part of the outer window.

3. The door as claimed in claim 1, wherein the outer window is attached to the front surface of the outer door frame with a fixing agent, and the inner window is attached to the rear surface of the inner door frame with the fixing agent.

4. The door as claimed in claim 3, wherein the fixing agent is a liquid sealant.

5. The door as claimed in claim 3, wherein the fixing agent for attaching the outer window has a color the same with a paint coated on the door frame.

6. The door as claimed in claim 3, wherein the fixing agent for attaching the outer window has a color the same with a paint coated on the door frame.

7. The door as claimed in claim 1, wherein the outer window and the inner window are formed of glass.

8. The door as claimed in claim 1, wherein the gasket has hook parts for joining with the inner door frame, and the inner door frame has gasket holes in the rear surface for inserting the hook parts to fix the gasket.

9. The door as claimed in claim 8, wherein the inner door frame further includes a width of seating groove in conformity with the gasket in the rear surface, and the gasket holes are formed within the seating groove.

10. The door as claimed in claim 1, wherein the inner door frame further includes a width of seating surface around the second central opening in the rear surface thereof for placing an edge surface of the inner window.

11. The door as claimed in claim 10, wherein the door frame further includes a bent part projected backward from an outer circumference of the seating surface for increasing a rigidity of an inner window attaching region.

12. The door as claimed in claim 1, wherein the outer window has a coat of ceramic paint applied to an inside surface of an entire part thereof excluding a part facing the opening of the door frame.

13. The door as claimed in claim 1, wherein the slope angle $\alpha$ is in a range of 1°~20°.

14. The door as claimed in claim 1, wherein the slope angle $\alpha$ is in a range of 8°~10°.

15. The door as claimed in claim 1, wherein the second flange is joined with the first flange.

16. The door as claimed in claim 15, wherein the first flange has a plurality of hooks on an outer circumferential surface, and the second flange has hook fastening holes fastened to the hooks respectively.

17. The door as claimed in claim 1, wherein the outer door frame has a rim projected forward from a front circumference thereof for enclosing an outer circumference of the outer window to protect an edge part of the outer window.

18. The door as claimed in claim 1, wherein the outer window is attached to the front surface of the outer door frame with a fixing agent, and the inner window is attached to the rear surface of the inner door frame with the fixing agent.

19. The door as claimed in claim 18, wherein the fixing agent for attaching the outer window has a color the same with a paint coated on the outer door frame.

20. The door as claimed in claim 18, wherein the fixing agent for attaching the outer window has a color similar to a paint coated on the outer door frame.

21. The door as claimed in claim 1, wherein the outer door frame further includes a plurality of hooks on an inside of an outer rim surface, and the inner door frame further includes hook holes in an outer rim thereof for joining with the hooks.

22. A laundry dryer/drum type washing machine comprising:

a cabinet having an opening for introduction/taking out of laundry therethrough;

a drum rotatably mounted in the cabinet, having a plurality of lifts on an inside circumferential surface;

a motor for providing a driving power to the drum;

a door for opening/closing an opening in the cabinet, the door comprising:

an outer door frame having a first central opening and a first flange projected backward from a periphery of the first central opening, wherein a top of the first flange projects into the drum less than a bottom of the first flange such that a rear surface of the first flange forms a slope angle $\alpha$ when viewed from a side;

an inner door frame having a second central opening and a second flange projected from a periphery of the second central opening, wherein a rear surface of the second flange forms the slope angle $\alpha$ when viewed from a side;

an outer window mounted on a front surface of the outer door frame;

an inner window mounted on a rear surface of the inner door frame, wherein the inner window is inclined at the slope angle $\alpha$ when viewed from a side; and a gasket fixed to the rear surface of the inner door frame, wherein the gasket is adapted to prevent leakage of air from an inside to an outside of the cabinet and wherein the second frame and the gasket are hidden from view from an outside of the cabinet by the first flange, wherein the outer door frame has a front surface curved in left/right directions and the outer window is curved the same way as the front surface of the outer door frame.

23. The laundry dryer/drum type washing machine as claimed in claim 22, wherein the outer door frame is joined to, the inner door frame.

* * * * *